US009122293B2

(12) United States Patent
Price et al.

(10) Patent No.: US 9,122,293 B2
(45) Date of Patent: Sep. 1, 2015

(54) METHOD AND APPARATUS FOR LDO AND DISTRIBUTED LDO TRANSIENT RESPONSE ACCELERATOR

(71) Applicant: QUALCOMM Incorporated, San Diego, CA (US)

(72) Inventors: Burt L. Price, Raleigh, NC (US); Dhaval R. Shah, Raleigh, NC (US); Yeshwant Nagaraj Kolla, Wake Forest, NC (US)

(73) Assignee: QUALCOMM Incorporated, San Diego, CA (US)

( * ) Notice: Subject to any disclaimer, the term of this patent is extended or adjusted under 35 U.S.C. 154(b) by 126 days.

(21) Appl. No.: 13/788,354

(22) Filed: Mar. 7, 2013

(65) Prior Publication Data

US 2014/0117956 A1 May 1, 2014

Related U.S. Application Data

(60) Provisional application No. 61/720,423, filed on Oct. 31, 2012.

(51) Int. Cl.

| | |
|---|---|
| ***G05F 1/00*** | (2006.01) |
| ***G05F 1/613*** | (2006.01) |
| ***G05F 1/575*** | (2006.01) |

(52) U.S. Cl.

CPC ..... *G05F 1/613* (2013.01); *G05F 1/575* (2013.01)

(58) Field of Classification Search

USPC ..... 323/265, 268, 269, 270, 273, 274, 280

See application file for complete search history.

(56) References Cited

U.S. PATENT DOCUMENTS

| | | | | |
|---|---|---|---|---|
| 4,656,647 | A * | 4/1987 | Hotine | 375/279 |
| 5,696,465 | A | 12/1997 | Ishizuka | |
| 5,982,226 | A | 11/1999 | Rincon-Mora | |
| 6,031,417 | A | 2/2000 | Bechman | |
| 6,046,577 | A | 4/2000 | Rincon-Mora et al. | |
| 6,184,744 | B1 | 2/2001 | Morishita | |
| 6,188,211 | B1 | 2/2001 | Rincon-Mora et al. | |

(Continued)

FOREIGN PATENT DOCUMENTS

| | | | |
|---|---|---|---|
| CN | 102117089 | A | 7/2011 |
| EP | 1635239 | A1 | 3/2006 |

(Continued)

OTHER PUBLICATIONS

Cristea I., et al., "Supply Concept in Input Powered Two Channel Switch", Semiconductor Conference (CAS), 2010 International, IEEE, Piscataway, NJ, USA, Oct. 11, 2010, pp. 469-472, XP031812172, ISBN: 978-1-4244-5783-0.

(Continued)

*Primary Examiner* — Adolf Berhane
*Assistant Examiner* — Kevin H Sprenger
(74) *Attorney, Agent, or Firm* — Nicholas J. Pauley; Peter Michael Kamarchik; Paul Holdaway

(57) ABSTRACT

A transient response accelerated (TRA) low dropout (LDO) regulator has an error amplifier having a feedback input, and a reference input configured to receive a reference voltage, and an output that controls a pass gate. The pass gate output voltage is applied to the feedback input. A transient response accelerator (TRA) circuit detects a rapid voltage drop on the pass gate output and, in response, applies a pulse control that rapidly lowers the resistance of the pass gate.

20 Claims, 7 Drawing Sheets

(56) References Cited

U.S. PATENT DOCUMENTS

| | | | | |
|---|---|---|---|---|
| 6,188,212 | B1 | 2/2001 | Larson et al. | |
| 6,246,221 | B1 * | 6/2001 | Xi | 323/280 |
| 6,333,623 | B1 | 12/2001 | Heisley et al. | |
| 6,373,233 | B2 | 4/2002 | Bakker et al. | |
| 6,518,737 | B1 | 2/2003 | Stanescu et al. | |
| 6,522,111 | B2 | 2/2003 | Zadeh et al. | |
| 6,617,833 | B1 | 9/2003 | Xi | |
| 6,703,815 | B2 | 3/2004 | Biagi | |
| 7,091,710 | B2 | 8/2006 | Yang et al. | |
| 7,142,022 | B2 | 11/2006 | Kang et al. | |
| 7,215,103 | B1 | 5/2007 | Wong et al. | |
| 7,224,156 | B2 * | 5/2007 | Chen | 323/316 |
| 7,339,416 | B2 | 3/2008 | Rincon-Mora et al. | |
| 7,612,547 | B2 * | 11/2009 | Renous | 323/280 |
| 7,728,569 | B1 | 6/2010 | Le et al. | |
| 7,768,351 | B2 | 8/2010 | Ivanov et al. | |
| 8,044,653 | B2 | 10/2011 | Maige et al. | |
| 8,072,196 | B1 | 12/2011 | Li | |
| 8,080,983 | B2 | 12/2011 | Lourens et al. | |
| 8,169,203 | B1 | 5/2012 | Vemula | |
| 8,242,761 | B2 * | 8/2012 | Napravnik | 323/280 |
| 2005/0231180 | A1 | 10/2005 | Nagata et al. | |
| 2006/0055383 | A1 * | 3/2006 | Eberlein | 323/280 |
| 2006/0232327 | A1 | 10/2006 | Takagi et al. | |
| 2008/0061881 | A1 | 3/2008 | Takagi | |
| 2008/0224680 | A1 | 9/2008 | Suzuki | |
| 2009/0066306 | A1 | 3/2009 | Noda | |
| 2009/0072984 | A1 | 3/2009 | Cheng et al. | |
| 2010/0013449 | A1 | 1/2010 | Miki | |
| 2010/0156364 | A1 | 6/2010 | Cho et al. | |
| 2011/0241769 | A1 | 10/2011 | Jung | |
| 2012/0161734 | A1 | 6/2012 | Wu | |
| 2012/0176107 | A1 | 7/2012 | Shrivas et al. | |
| 2012/0212199 | A1 | 8/2012 | Amer et al. | |
| 2012/0229202 | A1 | 9/2012 | Nikolov et al. | |
| 2014/0117958 | A1 | 5/2014 | Price et al. | |
| 2014/0125300 | A1 | 5/2014 | Price et al. | |
| 2014/0139197 | A1 | 5/2014 | Price et al. | |

FOREIGN PATENT DOCUMENTS

| | | | |
|---|---|---|---|
| EP | 2082680 | A1 | 7/2009 |
| JP | 2001137182 | A | 5/2001 |
| JP | 2005205072 | A | 8/2005 |
| JP | 2006230680 | A | 9/2006 |
| JP | 2007280025 | A | 10/2007 |
| KR | 20090028282 | A | 3/2009 |
| WO | 2012104673 | A1 | 8/2012 |

OTHER PUBLICATIONS

International Search Report and Written Opinion—PCT/US2013/067213—ISA/EPO—Mar. 6, 2014.

Kim Y.I., et al., "Fast Transient Capacitor-Less LDO Regulator Using Low-Power Output Voltage Detector", Electronics Letters, IEE Stevenage, vol. 48, No. 3, Feb. 2, 2012, pp. 175-177, XP006040603, ISSN: 0013-5194, DOI: 10.1049/EL.2011.

Liu X. et al., "Design of off-chip capacitor-free CMOS low-dropout voltage regulator", Circuits and Systems, 2008. APCCAS 2008. IEEE Asia Pacific Conference on, IEEE, Piscataway, NJ, USA, Nov. 30, 2008, pp. 1316-1319, XP031405243, DOI: 10.1109/APCCAS.2008.4746270 ISBN: 978-1-4244-2341-5.

Ying O.P., et al., "An Output-Capacities Low-Dropout Regulator with Direct Voltage-Spike Detection", IEEE Journal of Solid-State Circuits, Service Center, Piscataway, NJ, USA, vol. 45, No. 2, Feb. 1, 2010, pp. 458-466, XP011301260, ISSN: 0018-9200, DOI: 10.1109/JSSC.2009.2034805.

International Search Report and Written Opinion—PCT/US2013/068522—ISA/EPO—Jun. 30, 2014.

* cited by examiner

METHOD AND APPARATUS FOR LDO AND DISTRIBUTED LDO TRANSIENT RESPONSE ACCELERATOR

CLAIM OF PRIORITY UNDER 35 U.S.C. §119

The present Application for Patent claims priority to Provisional Application No. 61/720,423 entitled "METHOD AND APPARATUS FOR LDO AND DISTRIBUTED LDO TRANSIENT RESPONSE ACCELERATOR" filed Oct. 31, 2012, and assigned to the assignee hereof and hereby expressly incorporated by reference herein.

FIELD OF DISCLOSURE

The technical field of the disclosure relates to voltage regulators and, more particularly, to low dropout (LDO) regulators.

BACKGROUND

An LDO regulator is a direct current (DC) linear voltage regulator that can operate with a very low dropout, where "dropout" (also termed "dropout voltage") means the difference between the input voltage (e.g., received power supply rail voltage) and the regulated out voltage. As known in the conventional voltage regulator arts, low dropout voltage may provide, for example, higher efficiency and concomitant reduction in heat generation, and may provide for lower minimum operating voltage.

SUMMARY

The following summary is not an extensive overview of all contemplated aspects. Its sole purpose is to present some concepts of one or more aspects in a simplified form as a prelude to the more detailed description that is presented later.

One exemplary embodiment provides a transient response accelerated low dropout (LDO) regulator, which may include an error amplifier having a feedback input, an error output, and a reference input configured to receive a reference voltage, a pass gate having a control gate coupled to the error output, an input configured to receive a supply voltage, and a pass gate output, wherein the pass gate output is coupled to the feedback input, and a transient response accelerator (TRA) circuit coupled to the pass gate output and configured to apply, in response to a voltage drop on the pass gate output, a TRA boost to the control gate.

In an aspect, the TRA circuit may be configured to apply the TRA boost at a magnitude dependent, at least in part, on a rate of the voltage drop.

In accordance with one or more exemplary embodiments, one example TRA circuit may include a pass gate kick transistor having a drain coupled to the control gate of the pass gate, and having a gate, a voltage change triggered control circuit having an input coupled by a coupling capacitor to the pass gate output and having a kick output that is coupled to the gate of the pass gate kick transistor. In aspect, the voltage change triggered control circuit can be configured to apply through the kick output, in response to a voltage drop on the pass gate output, a boost voltage to the gate of the pass gate kick transistor, at a magnitude corresponding to a rate of the voltage drop. In a related aspect, the pass gate kick transistor may be configured to pull a voltage on the control gate of the pass gate, in response to the boost voltage, by a magnitude based, at least in part, on the boost voltage.

In an aspect, one example voltage change triggered control circuit may be further configured to output, in response to a voltage increase on the pass gate output, a boost disable voltage to the gate of the pass gate kick transistor, and the pass gate kick transistor may be configured to switch OFF in response to the boost disable voltage.

In a further aspect, one example voltage change triggered control circuit can include an inverter amplifier having an inverter input coupled by a coupling capacitor to the input of the voltage change triggered control circuit, and having an inverter output coupled to the kick output, an inverter bias feedback resistor coupled between the inverter input and the inverter output, and an inverter bias current source feeding a current to the inverter input.

In an aspect, one example pass gate kick transistor may have a given threshold voltage ($V_{TH}$), and the current that is fed by the inverter bias current source can be a pass gate kick transistor bias control current having a magnitude that sets, at the kick output, a static bias voltage within a range from slightly less than $V_{TH}$ to approximately equal to $V_{TH}$.

In an aspect, one example inverter amplifier may include a complementary metal oxide (CMOS) inverter circuit, and the inverter bias feedback resistor may be a Class A bias resistor having a resistance that maintains the complementary metal oxide (CMOS) inverter circuit in a Class A mode of operation.

In another aspect, one example voltage change triggered control circuit may include an NMOS transistor having a gate coupled to the input of the voltage change triggered control circuit, a drain coupled to the kick output and a biasing network coupled to the gate, configured to bias the NMOS transistor as a Class A amplifier.

In another aspect, one example voltage change triggered control circuit may include an NMOS transistor having a drain coupled to the kick output, a gate coupled to the input of the voltage change triggered control circuit, and a source configured for coupling to a reference rail, and may include a bias control resistor having one end coupled to the drain of the NMOS transistor; a PMOS transistor having a drain coupled to another end of the bias control resistor, a gate coupled to the gate of the NMOS transistor, and a source configured for coupling to a Vdd power rail, and may further include a self-bias resistor coupling the drain of the NMOS transistor to the source of the NMOS transistor.

In an aspect, one example voltage change triggered control circuit can include a bias current source having an input configured for coupling to a power rail and having an output, a bias control resistor coupled at one end to the output of the bias current source, an NMOS transistor having a drain coupled to another end of the bias control resistor and to the output of the voltage change triggered control circuit, a gate coupled to the input of the voltage change triggered control circuit, and a source configured for coupling to a reference rail; and a self-bias resistor coupling the drain of the NMOS transistor to the source of the NMOS transistor. In one further aspect, the bias current source can feed a bias current through the bias control resistor and the NMOS transistor.

One or more exemplary embodiments may provide a method for providing a transient response accelerated low dropout (LDO) voltage regulation, and operations may include controlling a resistance of a pass gate based on a regulator output voltage at an output of the pass gate output and a reference voltage; and in response to a drop in the regulator output voltage, overriding the controlling and forcing the pass gate to a reduced resistance value.

One or more exemplary embodiments may provide an apparatus for transient response accelerated low dropout (LDO) voltage regulation, and may include means for controlling a resistance of a pass gate based on a regulator output voltage at an output of the pass gate output and a reference voltage; and means for overriding, in response to a drop in the regulator output voltage, the controlling a resistance and forcing the pass gate to a reduced resistance value.

BRIEF DESCRIPTION OF THE DRAWINGS

The accompanying drawings found in the attachments are presented to aid in the description of embodiments of the invention and are provided solely for illustration of the embodiments and not limitation thereof.

DETAILED DESCRIPTION

Figure 1:
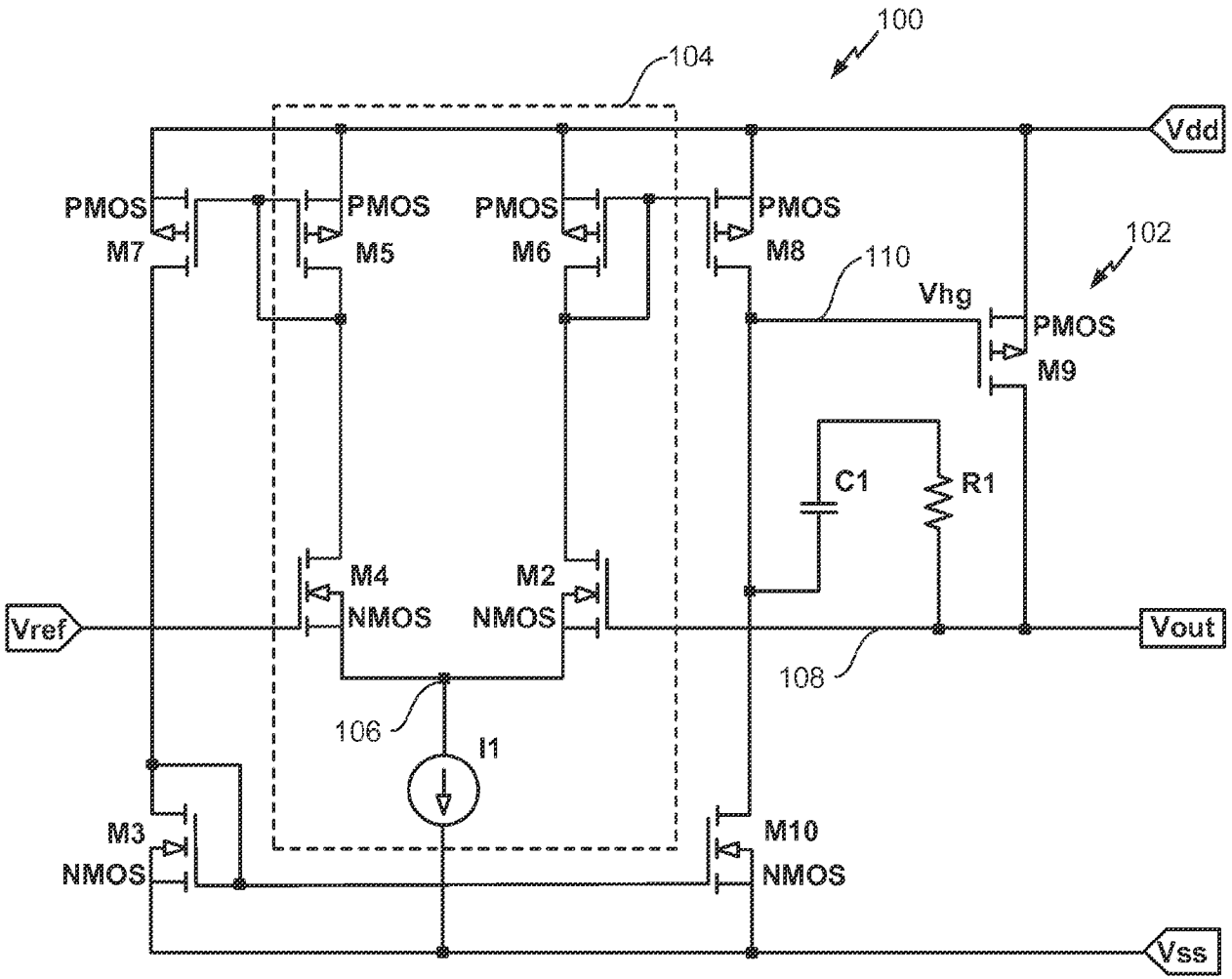
FIG. 1 shows a topology for a fast transient response LDO unit.

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is only for the purpose of describing particular examples according to embodiments, and is not intended to be limiting of embodiments of the invention. As used herein, the singular forms "a", "an" and "the" are intended to include the plural forms as well, unless the context clearly indicates otherwise. As used herein the terms "comprises", "comprising,", "includes" and/or "including" specify the presence of stated structural and functional features, steps, operations, elements, and/or components, but do not preclude the presence or addition of one or more other structural and functional feature, steps, operations, elements, components, and/or groups thereof.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields, electron spins particles, electrospins, or any combination thereof.

The term "topology" as used herein refers to interconnections of circuit components and, unless stated otherwise, indicates nothing of physical layout of the components or their physical locations relative to one another. Figures described or otherwise identified as showing a topology are no more than a graphical representation of the topology and do not necessarily describe anything regarding physical layout or relative locations of components.

The term "conducting path" as used herein in the context of describing a specific current flow between first and second nodes, or between an "input" and an "output," or between a "node A" and "a node "B") is a collective reference to all structure(s) through which the specific current flows in going from A to B. For example, in the context of describing current flow between a source and a drain of a given FET, the conducting path is the body of the FET.

The term "parallel," as used herein in describing two or more conducting paths being "parallel" to one another, means that the respective voltage drop across the two or more parallel conducting paths is the same, identical, voltage.

The term "series," as used herein in describing two or more devices or conducting paths being in "series" with one another, means the same, identical current flows through each of the two or more devices or conducting paths.

FIG. 1 shows a topology for one example fast transient response LDO regulator 100. The fast transient response LDO regulator 100 regulates Vout by controlling the resistance of the PMOS pass gate 102 (hereinafter referenced as "pass gate 102"), using a feedback of Vout, to a resistance at which Vout is, in this example, approximately equal to Vref. It will be understood that Vout being approximately equal to Vref is only for purposes of example. For example, a voltage divider (not shown) can be included to generate Vout higher than Vref.

Continuing to refer to FIG. 1, the fast transient response LDO regulator 100 includes a differential amplifier 104 having a reference leg (shown but not separately numbered) formed of PMOS transistor M5 (hereinafter referenced as "M5") in series with NMOS transistor M4 (hereinafter referenced as "M4") extending between Vdd and common node 106. Parallel to the reference leg is a regulator control leg (shown but not separately numbered) formed of PMOS transistor M6 (hereinafter referenced as "M6") in series with NMOS transistor M2 (hereinafter referenced as "M2"). Constant current source I1 couples the common node 106 to the reference rail Vss. The gate of M4 of the reference leg receives Vref. The gate of M2 is coupled by a feedback path 108 to a regulator output voltage, Vout, e.g., at the drain (i.e., output) of the pass gate 102.

A mirror current leg (shown but not separately labeled) formed of PMOS transistor M7 (hereinafter referenced as "M7") in series with NMOS transistor M3 (hereinafter referenced as "M3") establishes a current mirroring the current through the reference leg. Similarly, a mirror current leg (shown by not separately labeled), formed of PMOS transistor M8 (hereinafter referenced as "M8") in series with NMOS transistor M10 (hereinafter referenced as "M10"), establishes a current mirroring the current through the regulator control leg. It will be understood by persons of ordinary skill having view of this disclosure that M8 and M7 may be structured relative to M6 and M5, respectively, such that the described currents through M3 and M7 and through M8 and M10 are, respectively, proportional mirrors of the currents through the reference leg and the regulator control leg.

As previously described. Vout is coupled to the gate of M2 by the feedback path 108. Assuming M2 and M4 have the same current-voltage characteristics, the feedback operation forces Vhg, and therefore the resistance of the pass gate 102, to a level where Vout is approximately Vref. In other words, the steady state Vout is the M2 gate voltage, namely Vref at which the current through the regulator control leg is substantially the same as the current through the reference leg, i.e., one half of I1. The signal at the drain of M8 may be employed as a pass gate control signal that may be transmitted, for example, on a pass gate control line 110, to a pass gate control input (shown but not separately numbered) of the pass gate 102.

However, if an additional load is suddenly placed on the Vout terminal of the pass gate 102, loop delay in adjusting Vhg may result in a corresponding sudden drop in Vout. The time history of Vout settling back to Vref is dependent on specific loop characteristics, including the stability, provided by the particular structure of the fast transient response LDO regulator 100. Techniques for determining loop characteristics, including stability, are known to persons of ordinary skill in the art and, therefore, further detailed description is omitted.

In an aspect, the fast transient response LDO regulator 100 may include a Miller R-C feedback compensation network (shown but not separately labeled) formed, in the FIG. 1 example, by resistor R1 in series with capacitor C1, from Vout to the Vhg node. Depending on the values selected for R1 and C1, the Miller R-C feedback compensation network may provide an RC-type voltage pulse at the Vhg node in response to a rapid change of Vout. For example, in response to a rapid drop in Vout, the Miller R-C feedback compensation network may provide an RC-type negative pulse to the Vhg node. Since the pass gate 102 is coupled to the Vhg node, the RC-type negative pulse may provide a corresponding transient decrease in the resistance of the pass gate 102. The decreased resistance of the pass gate 102 may in turn offset, at least partially, the sudden increase in load.

Figure 2:
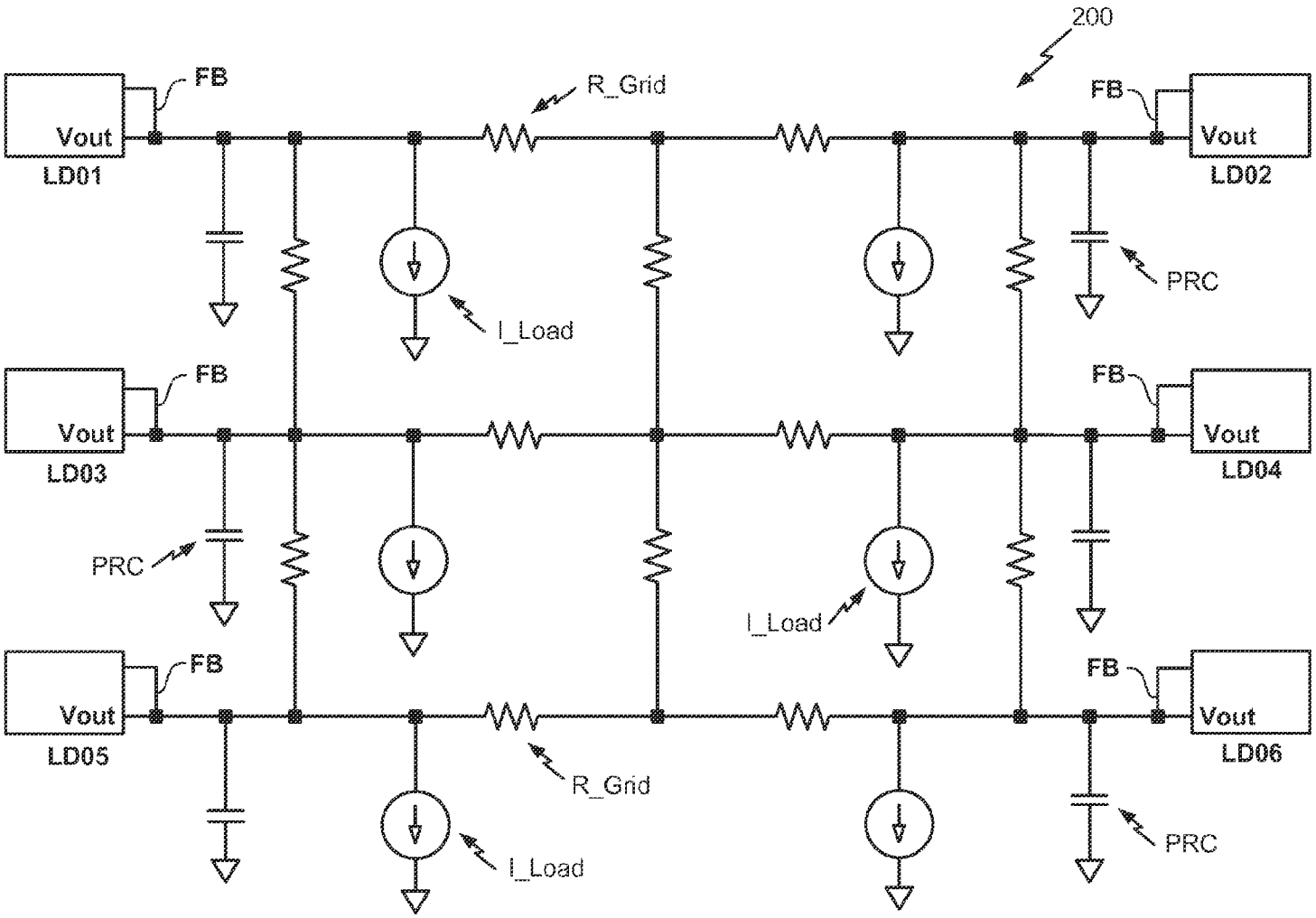
FIG. 2 shows a topology of a power distribution network having a plurality of FIG. 1 LDO units connected in parallel, and shows exemplary parasitic elements of the interconnecting power distribution network.

FIG. 2 shows a topology 200 with an example of six fast transient response LDO regulators, labeled LDO1, LDO2 . . . LDO6, arranged to operate in concert in feeding a power distribution network (shown but not individually labeled). The capacitor elements labeled "PRC" may represent discrete capacitor devices, load capacitances, and/or lumped element parasitic capacitances of the power distribution network. It will be understood that different instances of the capacitor elements PRC may represent different capacitance values. The resistor elements labeled "R_grid" represent resistances of the power distribution network. It will be understood that different instances of the resistor elements R_grid may have different resistances. The elements shown as current sources (or sinks) labeled "I_Load" represent loads on the power distribution network. It will be understood that different instances of the loads may have different values and that each may vary over time, for example, by rapid switch ON and switch OFF.

Continuing to refer to FIG. 2, in one configuration, each of the fast transient response LDO regulators LDO1, LDO2 . . . LDO6 can be according to the FIG. 1 fast transient response LBO regulator 100, with "FB" corresponding to the feedback path 108. In one such configuration, each of the LDO regulators LDO1, LDO2 . . . LDO6 may have a Vref input (not shown) coupled to a Vref source (not shown). In an aspect, at least one Vref source (not shown) may be shared by two or more of the of fast transient response LDO regulators LDO1, LDO2 . . . LDO6.

Referring to FIG. 1, as previously described, sudden placement of additional load on the Vout terminal, e.g., rapid switch ON and switch OFF of processor blocks, may cause a corresponding sudden drop in Vout. In an aspect, an amount of offset of the sudden drop in Vout may be provided by, for example, the Miller R-C feedback compensation network 150 from the Vout node to the Vhg node, the control gate of the pass gate 102. However, configuring the Miller R-C feedback compensation network 150 to provide such offset may compromise the stability of the LDO regulator 100.

One exemplary embodiment may provide one or more alternative means and methods for fast transient response LDO regulators that further provide, among other features, significant improvements in transient response, including speed and stability, simplicity of structure, and stability with respect to component drift, without compromise in stability of the LDO regulator.

Figure 3:
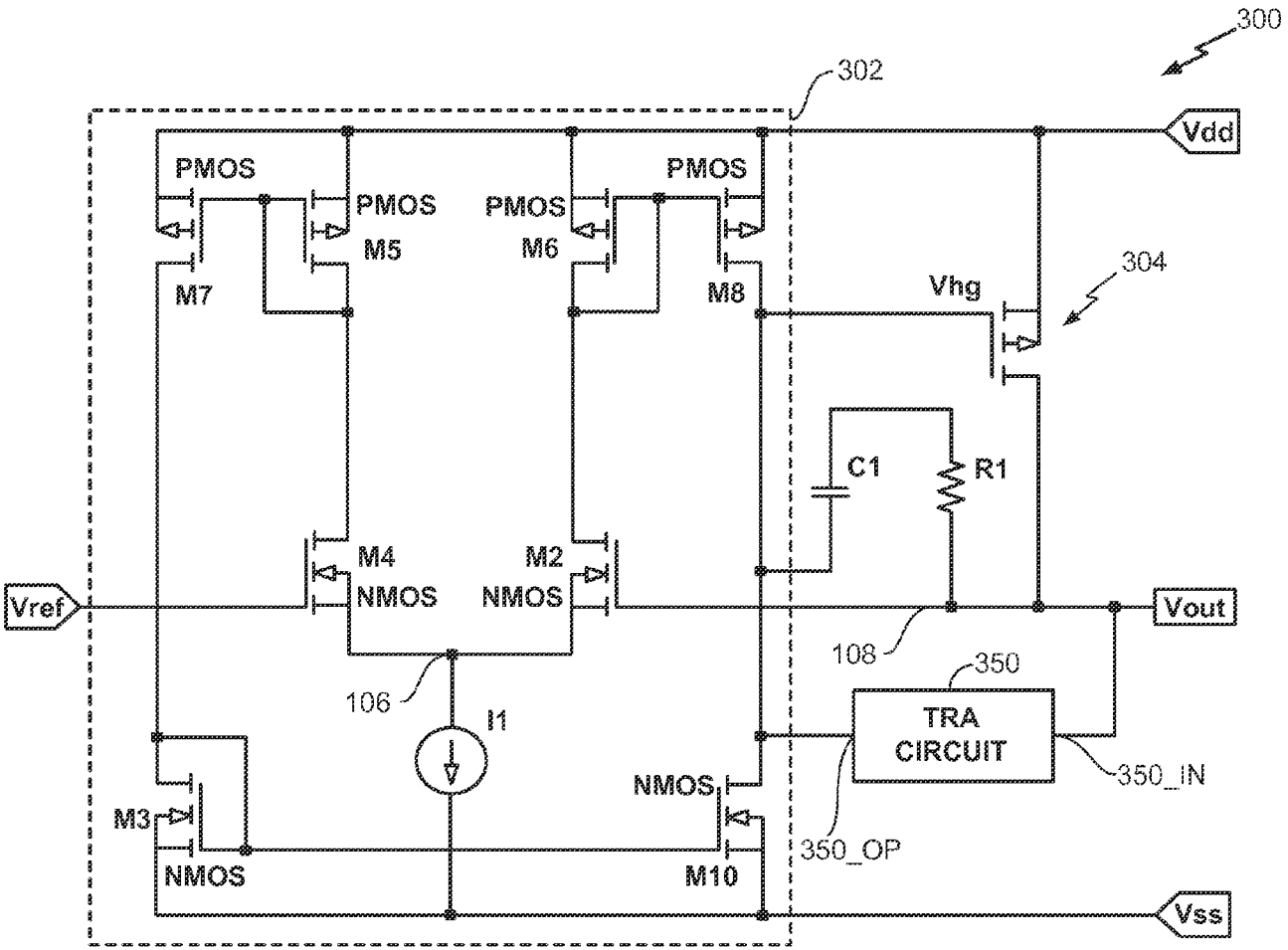
FIG. 3 shows a high-level topology of one example high bandwidth LDO with a transient response accelerator in accordance with various exemplary embodiments.

FIG. 3 shows a high-level topology of one example transient response accelerator (TRA) high bandwidth LDO 300 (hereinafter referred to as "TRA_LDO" 300) in accordance with one or more exemplary embodiments. Referring to FIG. 3, the TRA_LDO 300 may include a Vdd power rail providing a power rail voltage, e.g., Vdd volts, and a Vss power (or reference) rail providing a sink at a ground voltage Vss. The TRA_LDO 300 includes a differential or error amplifier 302 controlling a PMOS pass gate 304 (hereinafter "pass gate 304") coupled between a Vout terminal and the Vdd power rail. The output (shown but not separately numbered) of the error amplifier 302 can be coupled, for example, by the pass gate control line 306, to a control gate (shown but not separately numbered) of the pass gate 304. As shown, the FIG. 3 error amplifier 302 may be implemented with portions of the FIG. 1 differential amplifier 104. Portions of the FIG. 1 error amplifier 104 are used to avoid unnecessary complexity of describing new structures not necessarily specific to practices according to the embodiments. This is only one example of an error amplifier that may be used, however, and is not intended to limit the scope of any exemplary embodiments or any of their respective aspects.

In accordance with one or more exemplary embodiments, the TRA_LDO 300 further includes transient response accelerator (TRA) circuit 350, having an input 350_IN coupled to the Vout terminal, and an output 350_OP that may be coupled to the Vhg node, i.e., to the control gate (shown but not separately numbered) of the pass gate 304. As will be described in greater detail later, operations of the TRA circuit 350 according to various exemplary embodiments sink, or pull a boost current IBG from the Vhg node, into the 350_OP terminal of the TRA circuit 350, in response to a sudden drop in Vout. As will also be described in greater detail, the magnitude of IBG may correspond to, e.g., may be proportional to the rate of the drop in Vout, at least over a given range. In accordance with an aspect, pulling of the boost current IBG can effectuate a rapid boost in the voltage on the Vhg node, i.e., the control gate of the pass gate 304, without the delay of the feedback-control of the error amplifier 302. The rapid boost in voltage will be alternatively referenced as a "TRA boost voltage" or "TRA_BV" (not labeled on FIG. 3) The TRA circuit 350 can therefore provide, in accordance exemplary embodiments, supplemental, high-speed control of the pass gate 304 responsive to sudden drops in Vout. It will be understood that the term "TRA boost voltage" or "TRA_BV" means in a direction that increases the conductivity of the pass gate 304. Since the pass gate 304 of the FIG. 3 example is a PMOS device, "TRA boost voltage" means in a direction away from Vdd toward the reference voltage Vss. For example, assuming the pass gate 304 is a PMOS device, and assuming an arbitrary Vdd of 2.5 volts, in a hypothetical of TRA_BV being 1 volt, the resulting voltage on the Vhg node would be Vdd−TRA_BV=1.5 volts. In an alternative implementation according to one or more exemplary embodiments, an NMOS pass gate (not shown in the figures) may be substituted for the PMOS pass gate 304 and, in such an implementation, "TRA_BV" would mean in a direction away from Vss and toward Vdd.

For brevity, the boost current IBG pulled by the TRA circuit will be alternatively referred to as the "generated" boost current IBG, and the function or act of the TRA circuit 350 pulling the boost current IBG will be alternatively referred to as the TRA circuit 350 "generating" the boost current IBG.

As identified above, the TRA circuit 350 can generate boost current IBG at a magnitude based on, or dependent on a rate of the drop in Vout. In an aspect, the magnitude of IBG can be related to the rate, i.e., to dVout/dt, by a value "K" that can represent a gain of the TRA circuit 350. In an aspect, K, the gain of the TRA circuit 350 may be selected in view of a potential impact to instability, e.g., susceptibility to oscillation, if K is too large. In a further aspect, a structure of the TRA circuit 350 may limit the magnitude of IBG. Stated differently, according to this aspect, for a Vout droop having a slew rate dVout/dt, the TRA circuit 350 may generate IBG at a magnitude proportional (e.g., K) to dVout/dt up to a maximum of that slew rate, referenced herein as "MAX," at which the TRA circuit 350 saturates. The maximum Imag (IBG) may be referenced as I_MAX, and can be the saturation current of the TRA circuit 350. Imag(IBG) may remain at I_MAX for as long as dVout/dt of the voltage drop is above MAX.

Generation of IBG as described above can be represented, or approximated as $$Imag(IBG) \approx -K \cdot \frac{dVout}{dt}, \text{ if } dVout/dt \leq \text{MAX and} \qquad \text{Eq. (1)}$$
$$Imag(IBG) = \text{I_MAX for } dVout/dt > \text{MAX}$$

In an aspect, the TRA circuit 350 may be configured such that the maximum IBG, I_MAX, pulls the node Vhg to a hard ON voltage of the pass gate 304.

As described in the sections above, the boost current IBG pulls the Vhg to a voltage that depends, at least in part, on Imag(IBG). In other words, the TRA circuit 350 applies a TRA boost voltage, labeled TRA_BV, to the Vhg node. Therefore, TRA_BV may also be represented as a function of dVout/dt, as $$\text{TRA_BV} \approx M \cdot \frac{dVout}{dt}, \text{ if } dVout/dt \leq \text{MAX and} \qquad \text{Eq. (2)}$$
$$\text{TRA_BV} = \text{V_MAX, for } dVout/dt > \text{MAX}$$

where "M" is a scalar that corresponds, or approximately corresponds, IBG to TRA_BV. "V_MAX" is TRA_BV when the Vout is slewing above the rate MAX. As previously described "TRA boost voltage" means in a direction that increases the conductivity of the pass gate 304. Therefore, referring to Equation (2), since the pass gate 304 is a PMOS device the voltage on the Vhg node that may result from TRA_BV is TRA_BV, i.e., the right side of Equation (2), subtracted from Vdd.

It will be appreciated that the above-described generation of IBG, or TRA_BV, can provide, among various other features and benefits, rapid recovery and correction of Vout, without introduction of stability issues as may result from conventional techniques directed to increasing rates of transient response.

Figure 4:
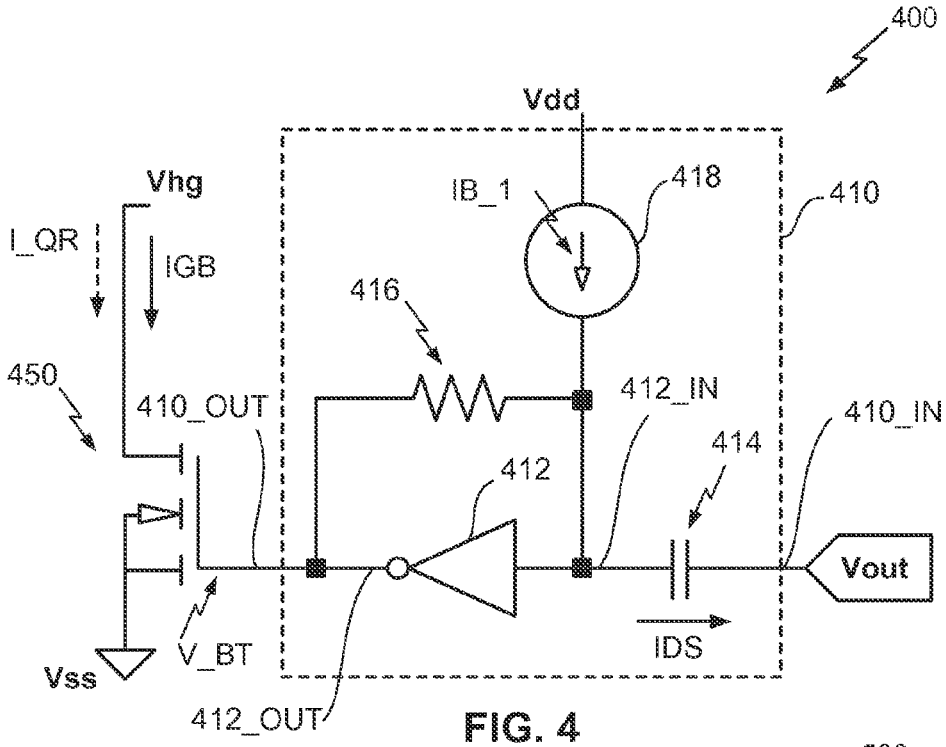
FIG. 4 shows a topology of one example transient response accelerator in accordance with one exemplary embodiment.

FIG. 4 shows a topology of one example transient response accelerator (TRA) circuit 400 in accordance with one or more exemplary embodiment. The TRA circuit 400 may implement, for example, the TRA circuit 350 of the FIG. 3 example TRA_LDO 300. Referring to FIG. 4, the TRA circuit 400 may include an NMOS transistor 450 having a drain (shown but not separately numbered) coupled to the Vhg node, and a source (shown but not separately numbered) coupled to a reference (e.g., ground) rail such as the Vss rail. In an aspect, the gate (shown but not separately numbered) of the NMOS transistor 450 is controlled by a control circuit 410. For convenience in describing various aspects and example operations, the NMOS transistor 450 will be alternatively referenced as the "pass gate kick transistor" 450, and the control circuit 410 will be alternatively referenced as the "pass gate kick controller" 410. It will be understood that "kick" has no descriptive meaning in this disclosure, and imports no meaning from outside this disclosure; it is, in this disclosure, simply a portion of a name.

Continuing to refer to FIG. 4, in an aspect, the pass gate kick controller 410 may include an inverter amplifier 412 having an output 412_OUT that may be coupled to, or may function as, an output 410_OUT of the pass gate kick controller 410. The output 412_OUT of the pass gate kick controller 410 is coupled to the gate of the pass gate kick transistor 450, and is hereinafter referenced alternatively as the "kick output" 410_OUT. The pass gate kick controller 410 may further include a sense input node, 410_IN, which may be capacitively coupled to Vout, e.g., the output of the FIG. 3 pass gate 304, through a coupling capacitor 414. As will be understood from this disclosure, the capacitance of the coupling capacitor 414 may be selected based, at least in part, on the anticipated ranges of dVout/dt, in conjunction with the selected gain of the pass gate kick controller 410.

In an aspect, the pass gate kick controller 410 may be configured to output, at 410_OUT, a pass gate boost voltage V_BT that is proportional to dVout/dt, at least over a given range of dVout/dt. The V_BT voltage is applied to the gate of the pass gate kick transistor 450 which response by generating a boost current IBG, i.e., pulling the boost current IBG from the Vhg node. In an aspect, the magnitude of IBG is proportional to V_BT up to a maximum of V_BT, at which point the pass gate kick transistor 450 may saturate. The pulling of the boost current IBG from the Vhg node directly pulls down the Vhg voltage.

Therefore, in accordance with various exemplary embodiments, the combination of the pass gate kick controller 410 and the pass gate kick transistor 450, in response to dVout/dt, may rapidly pull the Vhg voltage down. In other words, the combination of the pass gate kick controller 410 and the pass gate kick transistor 450 may apply, in response to dVout/dt, a pass gate boost voltage, TRA_BV that rapidly lowers or decreases the resistance of the pass gate 304. In accordance with Equations (1) and (2), the amount by which the resistance of the pass gate 304 is lowered us proportional to dVout/dt, up to a maximum at which the pass gate kick transistor 450 may saturate. The rapid reduction in the resistance of the pass gate 304 can provide, in turn, a current boost from the output of the pass gate 304 output. The current boost is straight from the Vdd rail, with no delay from the regular LDO feedback loop.

In an aspect, the pass gate kick controller 410 of FIG. 4, and alternative embodiments described in reference to FIGS. 5-8, may be configured to maintain a bias voltage on the gate of the pass gate kick transistor 450 while it is OFF. Further to the aspect, the pass gate kick controller 410, and alternative embodiments described in reference to FIGS. 5-8, may be configured to maintain a bias on the gate of the pass gate kick transistor 450, while in its OFF state, that is slightly below its given threshold voltage, $V_{TH}$. As will be appreciated, this aspect can avoid or sufficiently reduce an offset voltage that may arise from a quiescent current through the pass gate kick transistor 450, perturbing the output voltage away from Vref. In a further related aspect, pass gate kick controller 410, and alternative embodiments described in reference to FIGS. 5-8, may be configured to control, reduce, or reduce variation of a quiescent current draw by the pass gate kick transistor 450 while biased near its threshold $V_{TH}$.

Referring to FIG. 4, in an aspect, the inverter amplifier 412 may include devices (not explicitly shown), e.g., complementary metal oxide (CMOS) devices, configured such that the inverter amplifier 412 is capable of being biased into a Class A mode of operation. Example biasing circuitry and methods in accordance with various exemplary embodiments are described in greater detail at later sections. The aspect of biasing the inverter amplifier 412 into a Class A mode of operation may provide, for example, increased speed of operation. In an aspect, biasing of the inverter amplifier 412 into a Class A mode of operation may be provided by a self-bias resistor 416 (alternatively referenced as the "Class A bias resistor" 416) that couples the inverter amplifier output 412_OUT to the inverter amplifier input 412_IN. Techniques for implementing an inverter amplifier 412 capable of Class A operation are known to persons of ordinary skill in the relevant art and, therefore, further detailed description is omitted. As appreciated by persons of ordinary skill having possession of this disclosure, the resistance value (or range of resistance value) of the Class A bias resistor 416 to obtain Class A mode of operation can be application specific, but selection of the value for a given application can be readily performed by such persons without undue experimentation.

With continuing reference to FIG. 4, it will be understood that the gate kick transistor 450 has a threshold voltage, labeled herein as $V_{TH}$. In an aspect, the pass gate kick controller 410 further include a current source 418 feeding a bias current, labeled IB_1, to the input 412_IN of the inverter amplifier 412. The bias current IB_1 will therefore be alternatively referenced as the "bias control current" IB_1, and the current source 418 will be alternatively referenced as the "inverter bias current source" 418. In an aspect, the bias control current IB_1 may be set to a value that establishes at the kick output 412_OUT a static bias voltage that is near (i.e., slightly below) the $V_{TH}$ threshold voltage. Biasing the kick output 412_OUT according to this aspect may provide, among other benefits, significant reduction in a quiescent current, shown in dotted line and labeled I_QR, extracted from the Vhg node by pass gate kick transistor 450. It will be understood by persons of ordinary skill upon reading this disclosure that such reduction in quiescent current may, in turn, substantially eliminate or at least reduce any offset in Vhg and/or offset in Vout.

Description in preceding sections has referred to generating, i.e., pulling a current IBG from the Vhg node in response to a sharp or rapid drop in Vout, i.e., a negative dVout/dt. Referring to FIG. 4, the pulling of IBG is obtained because, when dVout/dt is negative, a current IDS flows through the coupling capacitor 414. In accordance with conventional inverting amplifier operation, the inverting amplifier 412 responds to IDS by increasing the V_BT voltage on the kick output 412_OUT, driving the pass gate kick transistor 450 to a state where it pulls a corresponding current from the Vhg node. In a related aspect, a sharp increase on Vout, i.e., a positive dVout/dt, can cause a current through the coupling capacitor 414 in a direction opposite IDS. The inverter amplifier 412, being biased in Class A operation, can respond by rapidly lowering the output voltage VBT to a level substantially below $V_{TH}$. This can rapidly switch OFF the pass gate kick transistor 450. In an operation as described, V_BT can operate as a pass gate boost disable voltage. When the rapid increase in Vout is over, the inverter amplifier 412 can settle back to the previously described quiescent state, which is biased in the Class A mode, with a static voltage V_BT slightly below the $V_{TH}$ threshold of the pass gate kick transistor 450.

For some applications, a reduction or at least a further control of a quiescent current through the pass gate kick transistor 450 may be desired. Various exemplary embodiments that may provide such reduction and/or control of the quiescent current through the pass gate kick transistor 450 will be described in greater detail in reference to FIGS. 5-8.

Figure 5:
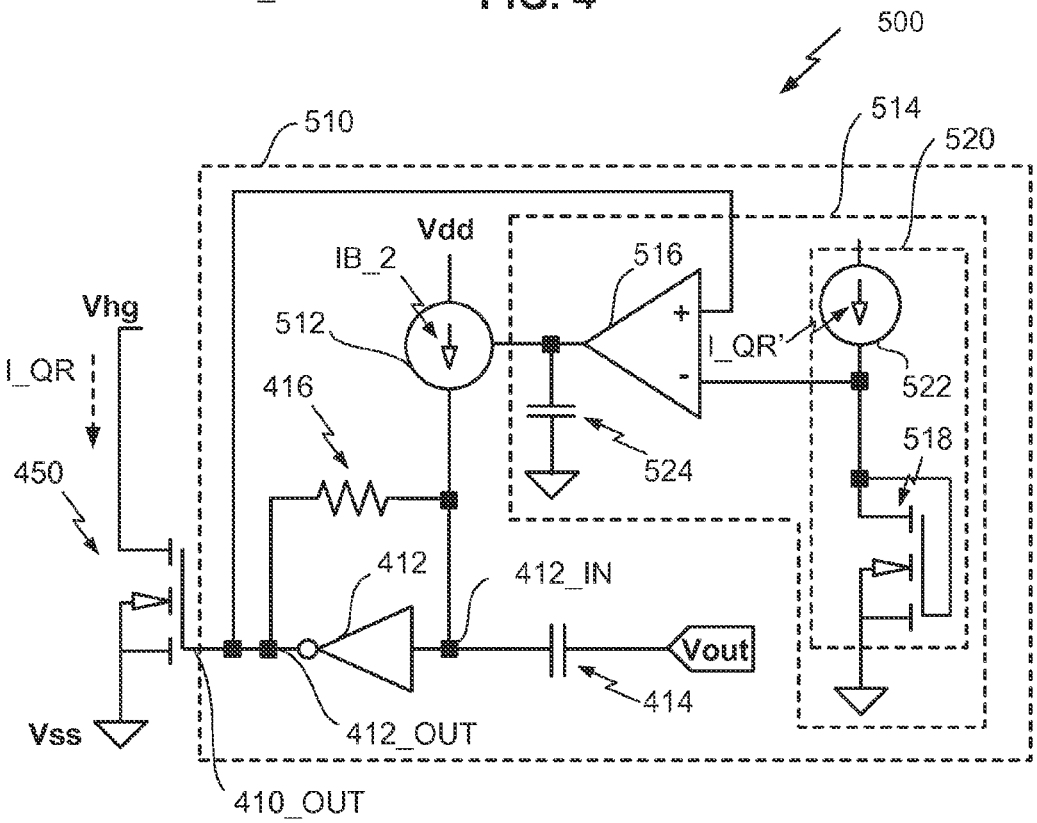
FIG. 5 shows a topology of one example transient response accelerator in accordance with one alternative exemplary embodiment.

FIG. 5 shows a topology of one example transient response accelerator (TRA) circuit 500 in accordance with another exemplary embodiment. It will be understood that the TRA circuit 500 can be another implementation of the FIG. 3 TRA circuit 350. The TRA circuit 500 is shown, for purposes of convenience, as an example having pass gate kick controller 510 incorporating portions of the FIG. 4 TRA pass gate kick controller 410.

Referring to FIG. 5, the pass gate kick controller 510 may substitute, for the FIG. 4 inverter bias current source 418, a controllable bias current source 512, controlled by inverter bias current control 514 to source IB_2. The inverter bias current control 514 may include difference amplifier 516 having a differential input (+) coupled to the gate of the pass gate kick transistor 450, and another differential input (−) coupled to the drain of a replica transistor 518 that is described in greater detail later. The difference amplifier 516 has an output (shown but not separately labeled) coupled to the control input (shown but not separately labeled) of the controllable inverter bias current source 512.

Continuing to refer to FIG. 5, the inverter bias current control 514 may include replica current bias circuit 520 having the above-mentioned replica transistor 518 having current-voltage characteristic that is identical to (or proportionally identical to) the current-voltage characteristic of the pass gate kick transistor 450. The FIG. 4 pass gate kick transistor 450 is an NMOS transistor and, therefore, the replica transistor 518 is an NMOS transistor. The replica transistor 518, in one aspect, has a drain (shown but not separately labeled) and a gate (shown but not separately labeled) coupled together and fed by a replica bias current source 522. The replica bias current source 522 may be configured to source a quiescent current, I_QR' that can be (or be proportional to) the desired value of the quiescent current I_QR through the pass gate kick transistor 450. The quiescent current I_QR' is hereinafter referenced alternatively as the "replica quiescent current" I_QR'. Further to one aspect, I_QR' may be selected to force the gate-to-source voltage of the replica transistor 520 to a value only slightly higher than its threshold voltage. The drain of the replica transistor 520, as described previously, may be coupled to the (−) input of the difference amplifier 516. The difference amplifier 516 thus compares the gate voltage of pass gate kick transistor 450 and to the gate voltage of replica transistor 520, and controls the controllable current source 522 to adjust IB_2 to force them to the same value, at least at low frequencies. In an aspect, a filtering capacitor 524 may be included.

Figure 6:
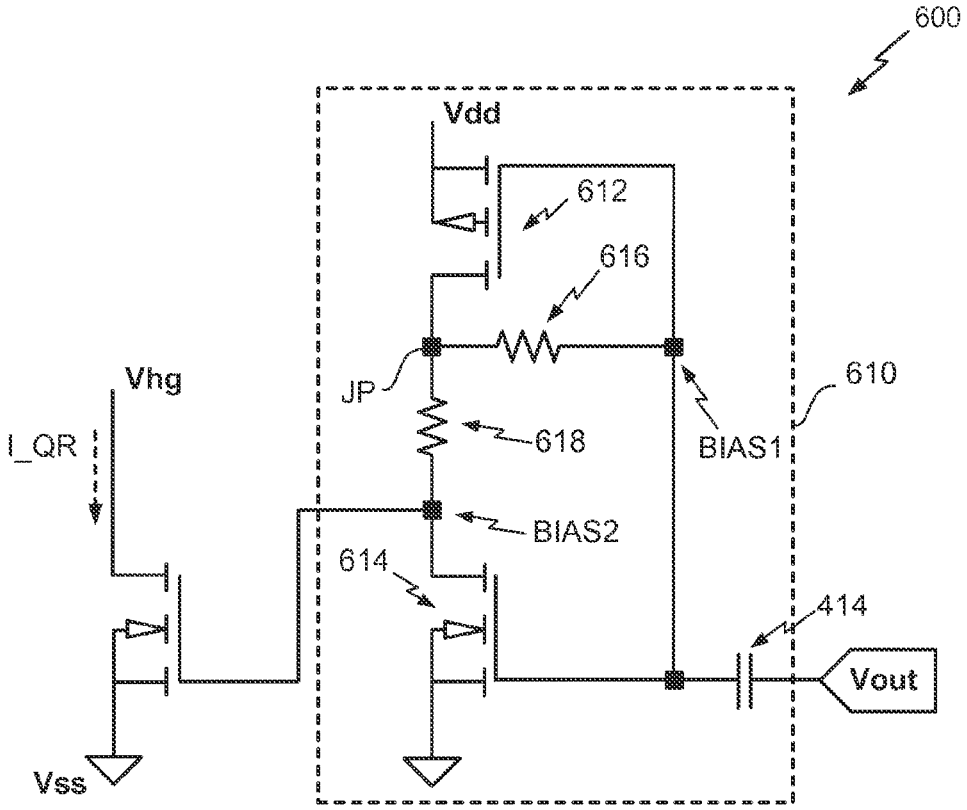
FIG. 6 shows a topology of one example transient response accelerator in accordance with another alternative exemplary embodiment.

FIG. 6 shows a topology of one example transient response accelerator (TRA) circuit 600 in accordance with another exemplary embodiment. It will be understood that the IRA circuit 600 is another example implementation of the FIG. 3 TRA circuit 350. The TRA circuit 600 is shown, for purposes of convenience, as an example having pass gate kick controller 610 incorporating portions of the FIG. 5 pass gate kick controller 510.

The pass gate kick controller 610 may include PMOS transistor 612 (referenced alternatively as "transistor 612") and the NMOS transistor 614 (referenced alternatively as "transistor 614"), with self-bias resistor 616 coupling the drain of the transistor 612 to the gate of the transistor 612 and the gate of the transistor 614. Bias control resistor 618 couples the drain of the transistor 612 to the drain of the transistor 614. As will be described in greater detail later, in an aspect, a resistance value of the bias control resistor 618 can be selected to establish a given static bias voltage, BIAS2, on the kick output 410_OUT. The given static bias voltage, in turn, can be selected, or determined based on a given acceptable quiescent current I_QR.

Referring to FIG. 6, in the disclosed arrangement, the transistor 612 and the transistor 614 provide an inverter function generally comparable to the inverter function of the FIG. 4 inverter amplifier 412. In an aspect, the resistor 616 may be selected at a resistance that establishes a BIAS1 voltage that biases the inverter formed by the transistor 612 and the transistor 614 as a Class A amplifier. In other words, the resistor 616 may be selected to provide self-biasing for a common source amplifier aspect of the transistor 614. Accordingly, the resistor 616 is alternatively referenced as the "self-bias" resistor 616. It will be understood that other alternative names for the resistor 616 may be used, without any change in the content or meaning of this disclosure. Examples include, but are not limited to, "Class A self-bias" resistor 616, and "common source self-biasing" resistor 616.

The resistance value of bias control resistor 618 may be selected to effect a voltage drop that subtracts from the gate-to-source voltage of the transistor 614, to select a BIAS2 voltage at the drain of the transistor 614. For example, as will be appreciated by persons of ordinary skill having view of this disclosure, the voltage on the gate of the NMOS transistor 614 is (assuming negligible voltage drop across the self-bias resistor 616), approximately the same as the voltage at the junction arbitrarily labeled "JP." Assuming the resistance of the bias control transistor 618 is non-zero, current flow through the PMOS transistor 612 and NMOS transistor 614 will cause a voltage drop across the bias control resistor 618. Therefore, the voltage on the kick output 410_OUT, i.e., the ate of the pass gate kick transistor 450 will be lower, by the voltage drop across the bias control transistor 618, than the voltage on the gate of the NMOS transistor 614. The gate-to-source voltage of the pass gate kick transistor 450, likewise, will be lower than the gate-to-source voltage of the NMOS transistor 614.

Referring to FIG. 6, in an aspect, the NMOS transistor 614 may be selected to have substantially the same current-voltage characteristics as the pass gate kick transistor 450. Further to this aspect, the resistance of the bias control resistor 618 may be selected to provide a static bias voltage BIAS2 near (i.e., slightly below) the $V_{TH}$ threshold voltage of the pass gate kick transistor 450. The static bias voltage BIAS2 according to the aspect, applied to the gate of the pass gate kick transistor 450, reduces its quiescent current relative to that in the transistor 614.

Figure 7:
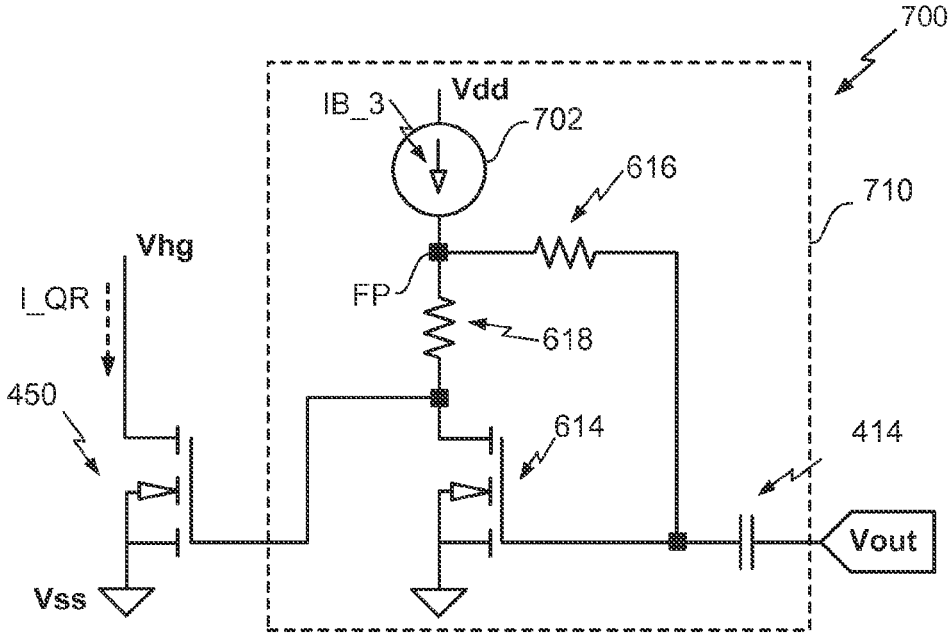
FIG. 7 shows a topology of one example transient response accelerator in accordance with another exemplary embodiment.

FIG. 7 shows a topology of one example transient response accelerator (TRA) circuit 700 in accordance with another exemplary embodiment. The TRA circuit 700 may implement the FIG. 3 TRA circuit 350. The TRA circuit 700 includes a pass gate kick controller 710 that will be described, for purposes of convenience, as incorporating portions of the FIG. 6 pass gate kick controller 610. The pass gate kick controller 710 can use, in place of the FIG. 6 PMOS transistor 612, a current source 702 that will be alternatively referenced as the "bias control current source" 702. The bias control current source 702 is configured to source a bias current IB_3. I3_2 may be viewed as a quiescent current through the NMOS transistor 614, at its operating point established by the self-bias resistor 616. Voltage drop across the self-bias resistor 616 may be negligible and, therefore, the voltage on the gate of the NMOS transistor 614 is approximately the same as the voltage at the feed point FP for the bias control current source 702. Assuming the resistance of the bias control transistor 618 is non-zero, the voltage on the kick output 410_OUT, i.e., the gate of the pass gate kick transistor 450, will therefore be lower (by IB_2 multiplied by the resistance of the bias control resistor 618) than the voltage on the gate of the NMOS transistor 614. The gate-to-source voltage of the pass gate kick transistor 450, likewise, will be lower than the gate-to-source voltage of the NMOS transistor 614.

Referring still to FIG. 7, in an aspect, the NMOS transistor 614 and the pass gate kick transistor 450 may have the same type and geometry. One example feature of this aspect is that (due to the voltage drop across the bias control resistor 618), for a given quiescent current through the bias control transistor 618, the corresponding quiescent current I_QR through the pass gate kick transistor 450 will be lower. Among features and benefits of a pass gate kick controller in accordance with the pass gate kick controller 710, as compared to the FIG. 6 pass gate kick controller 610, may be a further controllability of the quiescent current I_QR. In addition, as previously described, in an aspect, the resistance value of the self-bias resistor 618 may be selected to bias the transistor 614 as Class A. The Class A mode may significantly reduce delay in the NMOS transistor 614 responding to a rapid voltage drop on Vout.

It will be understood that embodiments contemplate a configuration with a zero-resistance bias control resistor 618, e.g., a metal trace (not specifically shown). In such a configuration, (assuming the NMOS transistor 614 and the pass gate kick transistor 450 have the same type and geometry), the quiescent current I_QR will be approximately the same as IB_3.

Figure 8:
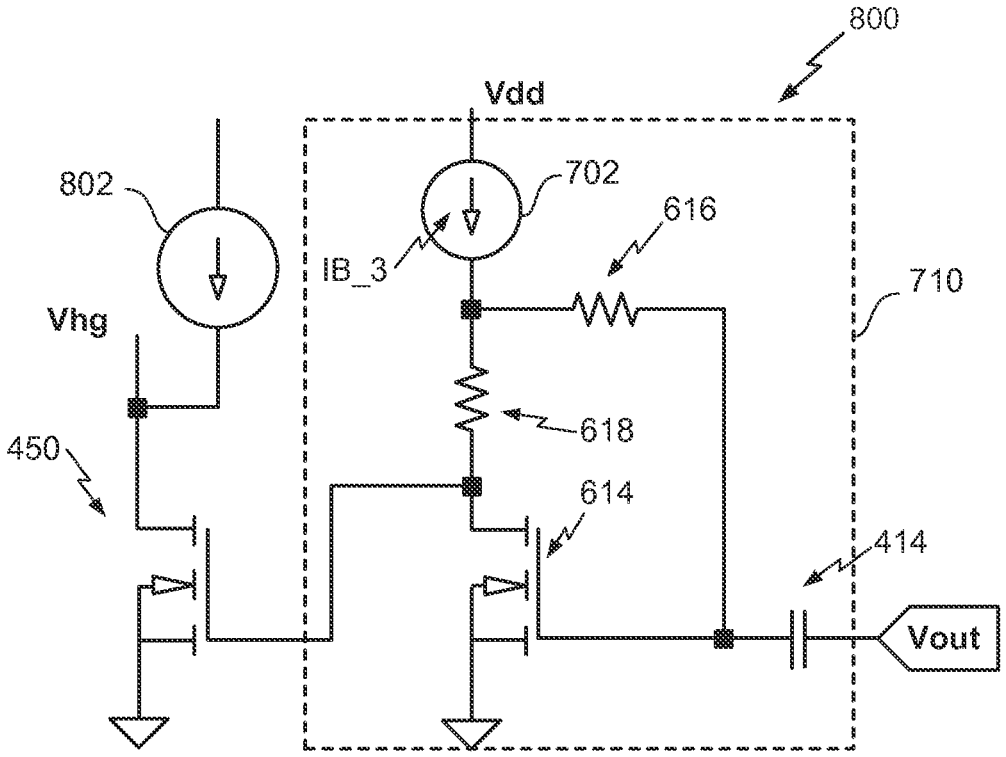
FIG. 8 shows a topology of one example transient response accelerator in accordance with another alternative exemplary embodiment.

FIG. 8 shows a topology of one example transient response accelerator (TRA) circuit 800 in accordance with another exemplary embodiment. The TRA circuit 800 is shown for purposes of convenience as utilizing FIG. 7 pass gate kick controller 710 and adding a compensation current source 802 feeding the Vhg node. The TRA circuit 800 may provide, by the compensation current source 802, a reduced quiescent current of pass gate kick transistor 450, and further control to compensate for process variations and operating temperature.

Referring back to FIG. 2, which shows an array of six LDO's connected in parallel, in such an arrangement using conventional LDOs, it may be generally expected that voltage offset of each of the paralleled LDO's may have an effect on current sharing between the LDOs (along with the low frequency loop gain of the LDO unit). In general, the LDO unit with an offset voltage that makes that LDO the one that would independently produce the highest output voltage will be the one that provides a larger portion of the output current. Transient response accelerator (TRA) enhanced LDO's will produce a better droop performance than the unenhanced versions due to the fact that they will transiently share load current better.

As can be appreciated, TRA equipped LDO's in accordance with various exemplary embodiments may provide, among other features and benefits, improved droop performance to fast attack edges of load current. TRA enhanced LDO's in accordance with various exemplary embodiments may further provide, among other features and benefits, improved phase margins over a wider load current range, and improved droop performance in paralleled LDO systems due to better transient current sharing.

Figure 9:
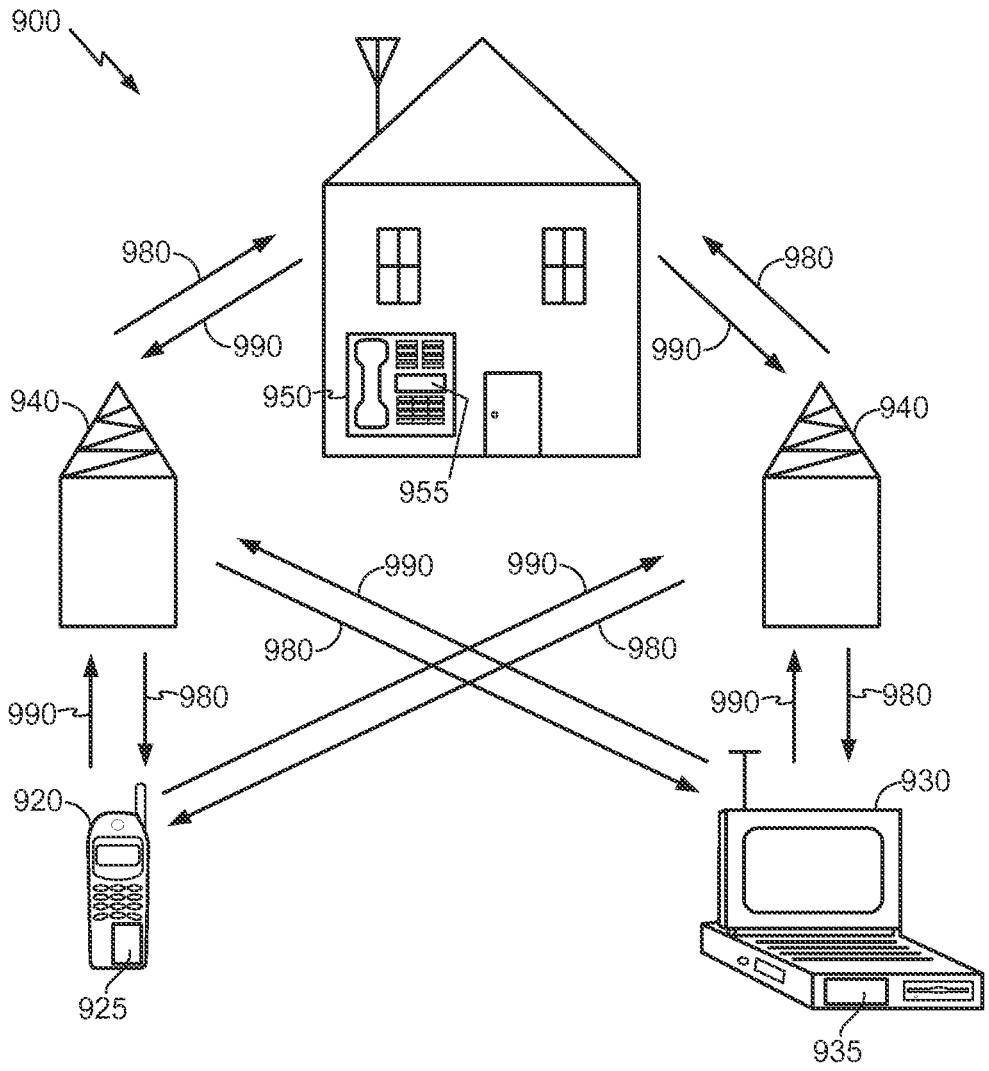
FIG. 9 shows one system diagram of one wireless communication system having, supporting, integrating and/or employing LDO units having transient response accelerators in accordance with one or more exemplary embodiments.

FIG. 9 illustrates an exemplary wireless communication system 900 in which one or more embodiments of the disclosure may be advantageously employed. For purposes of illustration, FIG. 9 shows three remote units 920, 930, and 950 and two base stations 940. It will be recognized that conventional wireless communication systems may have many more remote units and base stations. The remote units 920, 930, and 950 include integrated circuit or other semiconductor devices 925, 935 and 955 (including on-chip voltage regulators, as disclosed herein), which are among embodiments of the disclosure as discussed further below. FIG. 9 shows forward link signals 980 from the base stations 940 and the remote units 920, 930, and 950 and reverse link signals 990 from the remote units 920, 930, and 950 to the base stations 940.

In FIG. 9, the remote unit 920 is shown as a mobile telephone, the remote unit 930 is shown as a portable computer, and the remote unit 950 is shown as a fixed location remote unit in a wireless local loop system. For example, the remote units may be any one or combination of a mobile phone, hand-held personal communication system (PCS) unit, portable data unit such as a personal data assistant (PDA), navigation device (such as GPS enabled devices), set top box, music player, video player, entertainment unit, fixed location data unit such as meter reading equipment, or any other device that stores or retrieves data or computer instructions, or any combination thereof. Although FIG. 9 illustrates remote units according to the teachings of the disclosure, the disclosure is not limited to these exemplary illustrated units. Embodiments of the disclosure may be suitably employed in any device having active integrated circuitry including memory and on-chip circuitry for test and characterization.

The foregoing disclosed devices and functionalities (such as the devices of FIGS. 5A-5B, sequence of structures shown by FIGS. 6A-6F, methods of FIG. 7, or any combination thereof) may be designed and configured into computer files (e.g., RTL, GDSII, GERBER, etc.) stored on computer readable media. Some or all such files may be provided to fabrication handlers who fabricate devices based on such files. Resulting products include semiconductor wafers that are then cut into semiconductor die and packaged into a semiconductor chip. The semiconductor chips can be employed in electronic devices, such as described hereinabove.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

Accordingly, an embodiment of the invention can include a computer readable media embodying a method for implementation. Accordingly, the invention is not limited to illustrated examples and any means for performing the functionality described herein are included in embodiments of the invention.

The foregoing disclosed devices and functionalities may be designed and configured into computer files (e.g., RTL, GDSII, GERBER, etc.) stored on computer readable media. Some or all such files may be provided to fabrication handlers who fabricate devices based on such files. Resulting products include semiconductor wafers that are then cut into semiconductor die and packaged into a semiconductor chip. The chips are then employed in devices described above.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A transient response accelerated low dropout (LDO) regulator, comprising:

an error amplifier having a feedback input, an error output, and a reference input configured to receive a reference voltage;

a pass gate having a control gate coupled to the error output, a pass gate input configured to receive a supply voltage, and a pass gate output, wherein the pass gate output is coupled to the feedback input; and a transient response accelerator (TRA) circuit coupled to the pass gate output and configured to apply, in response to a voltage drop on the pass gate output, a TRA boost to the control gate, wherein the TRA comprises:

a pass gate kick transistor having a drain coupled to the control gate of the pass gate, and having a gate; and a voltage change triggered control circuit having an input coupled by a coupling capacitor to the pass gate output and having a kick output that is coupled to the gate of the pass gate kick transistor, wherein the voltage change triggered control circuit is configured to apply through the kick output, in response to a voltage drop on the pass gate output, a boost voltage to the gate of the pass gate kick transistor, at a magnitude corresponding to a rate of the voltage drop, and wherein the pass gate kick transistor is configured to pull a voltage on the control gate of the pass gate, in response to the boost voltage, by a magnitude based, at least in part, on the boost voltage, wherein the voltage change triggered control circuit includes:

a bias current source having an input configured for coupling to a power rail and having an output;

a bias control resistor coupled at one end to the output of the bias current source;

an NMOS transistor having a drain coupled to another end of the bias control resistor and to the output of the voltage change triggered control circuit, a gate coupled to the input of the voltage change triggered control circuit, and a source configured for coupling to a reference rail; and a self-bias resistor coupling the drain of the NMOS transistor to the source of the NMOS transistor, wherein the bias current source feeds a bias current through the bias control resistor and the NMOS transistor.

2. The transient response accelerated LDO regulator of claim 1, further comprising a compensation current source, coupled to the control gate of the pass gate.

3. The transient response accelerated LDO regulator of claim 1, wherein the self-bias resistor is a Class A self-bias resistor having a resistance that establishes at the gate of the NMOS transistor a bias voltage that biases the NMOS transistor as a Class A amplifier.

4. The transient response accelerated LDO regulator of claim 3, wherein the NMOS transistor and the pass gate kick transistor are structured to have substantially identical current-voltage characteristics.

5. The transient response accelerated LDO regulator of claim 4, wherein the bias current source is configured to feed the bias current as a quiescent current of the NMOS transistor, and wherein the bias control resistor has a resistance that provides, in response to the quiescent current of the NMOS transistor, a voltage drop that establishes a static bias voltage, at the kick output, that reduces a quiescent current of the pass gate kick transistor to the quiescent current of the NMOS transistor.

6. The transient response accelerated LDO regulator of claim 5, further comprising a compensation current source, coupled to the control gate of the pass gate.

7. The transient response accelerated LDO regulator of claim 4, wherein the pass gate kick transistor has a given threshold voltage ($V_{TH}$), and wherein the NMOS transistor is structured to have a threshold voltage that is substantially identical to $V_{TH}$.

8. The transient response accelerated LDO regulator of claim 7, wherein the bias current source is configured to feed the bias current as a quiescent current of the NMOS transistor, and wherein the bias control resistor has a resistance that provides, in response to the quiescent current of the NMOS transistor, a voltage drop that establishes a static bias voltage at the kick output that is within a range from slightly less than $V_{TH}$ to approximately equal to $V_{TH}$.

9. The transient response accelerated LDO regulator of claim 8, further comprising a compensation current source, coupled to the control gate of the pass gate.

10. A method for providing a transient response accelerated low dropout (LDO) voltage regulation, comprising:

providing an error amplifier having a feedback input, an error output, and a reference input configured to receive a reference voltage;

providing a pass gate having a control gate coupled to the error output, a pass gate input configured to receive a supply voltage, and a pass gate output, wherein the pass gate output is coupled to the feedback input; and providing a transient response accelerator (TRA) circuit coupled to the pass gate output and configured to apply, in response to a voltage drop on the pass gate output, a TRA boost to the control gate, wherein the TRA circuit comprises:

a pass gate kick transistor having a drain coupled to the control gate of the pass gate, and having a gate; and a voltage change triggered control circuit having an input coupled by a coupling capacitor to the pass gate output and having a kick output that is coupled to the gate of the pass gate kick transistor, wherein the voltage change triggered control circuit is configured to apply through the kick output, in response to a voltage drop on the pass gate output, a boost voltage to the gate of the pass gate kick transistor, at a magnitude corresponding to a rate of the voltage drop, wherein the pass gate kick transistor is configured to pull a voltage on the control gate of the pass gate, in response to the boost voltage, by a magnitude based, at least in part, on the boost voltage, and wherein the voltage change triggered control circuit includes:

a bias current source having an input configured for coupling to a power rail and having an output;

a bias control resistor coupled at one end to the output of the bias current source;

an NMOS transistor having a drain coupled to another end of the bias control resistor and to the output of the voltage change triggered control circuit, a gate coupled to the input of the voltage change triggered control circuit, and a source configured for coupling to a reference rail; and a self-bias resistor coupling the drain of the NMOS transistor to the source of the NMOS transistor, wherein the bias current source feeds a bias current through the bias control resistor and the NMOS transistor.

11. The method of claim 10, further comprising providing a compensation current source, coupled to the control gate of the pass gate.

12. An apparatus for transient response accelerated low dropout (LDO) voltage regulation, comprising:

means for providing an error amplifier having a feedback input, an error output, and a reference input configured to receive a reference voltage;

means for providing a pass gate having a control gate coupled to the error output, an input configured to receive a supply voltage, and a pass gate output, wherein the pass gate output is coupled to the feedback input; and means for providing a transient response accelerator (TRA) circuit coupled to the pass gate output and configured to apply, in response to a voltage drop on the pass gate output, a TRA boost to the control gate, wherein the TRA circuit comprises:

a pass gate kick transistor having a drain coupled to the control gate of the pass gate, and having a gate; and a voltage change triggered control circuit having an input coupled by a coupling capacitor to the pass gate output and having a kick output that is coupled to the gate of the pass gate kick transistor, wherein the voltage change triggered control circuit is configured to apply through the kick output, in response to a voltage drop on the pass gate output, a boost voltage to the gate of the pass gate kick transistor, at a magnitude corresponding to a rate of the voltage drop, wherein the pass gate kick transistor is configured to pull a voltage on the control gate of the pass gate, in response to the boost voltage, by a magnitude based, at least in part, on the boost voltage, and wherein the voltage change triggered control circuit includes:

a bias current source having an input configured for coupling to a power rail and having an output;

a bias control resistor coupled at one end to the output of the bias current source;

an NMOS transistor having a drain coupled to another end of the bias control resistor and to the output of the voltage change triggered control circuit, a gate coupled to the input of the voltage change triggered control circuit, and a source configured for coupling to a reference rail; and a self-bias resistor coupling the drain of the NMOS transistor to the source of the NMOS transistor, wherein the bias current source feeds a bias current through the bias control resistor and the NMOS transistor.

13. A transient response accelerated low dropout (LDO) regulator, comprising:

an error amplifier having a feedback input, an error output, and a reference input configured to receive a reference voltage;

a pass gate having a control gate coupled to the error output, a pass gate input configured to receive a supply voltage, and a pass gate output, wherein the pass gate output is coupled to the feedback input; and a transient response accelerator (TRA) circuit coupled to the pass gate output and configured to apply, in response to a voltage drop on the pass gate output, a TRA boost to the control gate, wherein the TRA comprises:

a pass gate kick transistor having a drain coupled to the control gate of the pass gate, and having a gate; and a voltage change triggered control circuit having an input coupled by a coupling capacitor to the pass gate output and having a kick output that is coupled to the gate of the pass gate kick transistor, wherein the voltage change triggered control circuit includes:

an NMOS transistor having a drain coupled to the kick output, a gate coupled to the input of the voltage change triggered control circuit, and a source configured for coupling to a reference rail;

a bias control resistor having one end coupled to the drain of the NMOS transistor;

a PMOS transistor having a drain coupled to another end of the bias control resistor, a gate coupled to the gate of the NMOS transistor, and a source configured for coupling to a Vdd power rail; and a self-bias resistor coupling the drain of the NMOS transistor to the source of the NMOS transistor.

14. The transient response accelerated LDO regulator of claim 13, wherein the self-bias resistor has a resistance that establishes at the gate of the NMOS transistor a bias voltage that biases the NMOS transistor as a Class A amplifier.

15. The transient response accelerated LDO regulator of claim 14, wherein the NMOS transistor and the pass gate kick transistor are structured to have substantially identical current-voltage characteristics.

16. The transient response accelerated LDO regulator of claim 15, wherein the bias control resistor has a resistance that provides a voltage drop, in response to a quiescent current of the NMOS transistor, that establishes a static bias voltage at the kick output that reduces a quiescent current of the pass gate kick transistor to the quiescent current of the NMOS transistor.

17. The transient response accelerated LDO regulator of claim 14, wherein the pass gate kick transistor has a given threshold voltage ($V_{TH}$), and wherein the NMOS transistor is structured to have a threshold voltage that is substantially identical to $V_{TH}$.

18. The transient response accelerated LDO regulator of claim 17, wherein the bias control resistor has a resistance that provides a voltage drop, in response to a quiescent current of the NMOS transistor, that establishes a static voltage at the kick output that is within a range from slightly less than $V_{TH}$ to approximately equal to $V_{TH}$.

19. A transient response accelerated low dropout (LDO) regulator, comprising:

an error amplifier having a feedback input, an error output, and a reference input configured to receive a reference voltage;

a pass gate having a control gate coupled to the error output, a pass gate input configured to receive a supply voltage, and a pass gate output, wherein the pass gate output is coupled to the feedback input; and a transient response accelerator (TRA) circuit coupled to the pass gate output and configured to apply, in response to a voltage drop on the pass gate output, a TRA boost to the control gate, wherein the TRA comprises:

a pass gate kick transistor having a drain coupled to the control gate of the pass gate, and having a gate; and a voltage change triggered control circuit having an input coupled by a coupling capacitor to the pass gate output and having a kick output that is coupled to the gate of the pass gate kick transistor, wherein the voltage change triggered control circuit is configured to apply through the kick output, in response to a voltage drop on the pass gate output, a boost voltage to the gate of the pass gate kick transistor, at a magnitude corresponding to a rate of the voltage drop, and wherein the pass gate kick transistor is configured to pull a voltage on the control gate of the pass gate, in response to the boost voltage, by a magnitude based, at least in part, on the boost voltage, wherein the voltage change triggered control circuit comprises:

an inverter amplifier having an inverter input coupled by a coupling capacitor to the input of the voltage change triggered control circuit, and having an inverter output coupled to the kick output;

an inverter bias feedback resistor coupled between the inverter input and the inverter output; and an inverter bias current source feeding a bias control current to the inverter input, wherein the pass gate kick transistor has a current-voltage characteristic, and wherein the inverter bias current source has a control input, and further comprising:

a difference amplifier having one differential input coupled to the gate of the pass gate kick transistor, another differential input coupled to the kick output, and having an output coupled to the control input of the inverter bias current source;

a replica current bias circuit having a replica transistor, having a current-voltage characteristic that is substantially the same as the current-voltage characteristic of the pass gate kick transistor, and having a drain coupled to another differential input of the difference amplifier, a gate coupled to said drain, and a replica bias current source feeding a replica quiescent current to said drain, and wherein the difference amplifier controls the inverter bias current source to set the magnitude of the bias control current having a magnitude that sets a quiescent current through the pass gate kick transistor substantially identical to the replica quiescent current.

20. The transient response accelerated LDO regulator of claim 19, wherein the inverter amplifier includes a complementary metal oxide (CMOS) inverter circuit, and wherein the inverter bias feedback resistor is a Class A bias resistor having a resistance that maintains the complementary metal oxide (CMOS) inverter circuit in a Class A mode of operation.

* * * * *